United States Patent [19]

Fischer

[11] 4,354,431

[45] Oct. 19, 1982

[54] PRINTING CYLINDER ENGAGEMENT PRESSURE REGULATING SYSTEM

[75] Inventor: Hermann Fischer, Augsburg, Fed. Rep. of Germany

[73] Assignee: M.A.N.-Roland Druckmaschinen Aktiengesellschaft, Augsburg, Fed. Rep. of Germany

[21] Appl. No.: 173,598

[22] Filed: Jul. 30, 1980

[30] Foreign Application Priority Data

Aug. 14, 1979 [DE] Fed. Rep. of Germany ..... 2932887

[51] Int. Cl.[3] ..... B41F 13/20; B41F 13/24; B41F 13/36

[52] U.S. Cl. ..... 101/247; 101/218; 101/177; 100/171

[58] Field of Search ..... 101/177, 247, 216–218, 101/348, 349, 153, 154, 181; 100/171, 169, 162 B

[56] References Cited

U.S. PATENT DOCUMENTS

| | | | |
|---|---|---|---|
| 1,584,828 | 5/1926 | Wood | 101/219 |
| 2,424,856 | 7/1947 | Schnnek | 100/169 |
| 2,971,457 | 2/1961 | Hold | 100/162 B |
| 3,199,442 | 8/1965 | Kuno et al. | 100/169 |
| 3,536,006 | 10/1970 | Roozee | 101/247 |
| 3,611,917 | 10/1971 | Bryce et al. | 100/162 B |
| 3,765,328 | 10/1973 | Treff et al. | 101/349 |
| 3,786,742 | 1/1974 | Hertrich | 100/171 |
| 3,983,811 | 10/1976 | Fuchs | 101/180 |
| 4,087,169 | 5/1978 | Fantuzzo | 100/171 |
| 4,137,844 | 2/1979 | Paulson | 101/177 |
| 4,192,229 | 3/1980 | Tsunoi et al. | 100/162 B |

FOREIGN PATENT DOCUMENTS

| | | | |
|---|---|---|---|
| 562168 | 8/1958 | Canada | 100/171 |
| 366420 | 1/1923 | Fed. Rep. of Germany | 100/171 |
| 2649052 | 6/1978 | Fed. Rep. of Germany | 101/177 |
| 2736175 | 2/1979 | Fed. Rep. of Germany | 101/177 |

*Primary Examiner*—William Pieprz

*Attorney, Agent, or Firm*—Frishauf, Holtz, Goodman & Woodward

[57] ABSTRACT

To suppress bending oscillations, particularly when tensioning or blanket attachment grooves of operating cylinders of a rotary printing machine, specifically of an offset printing machine, are engaged with each other, bearings (4) are supported by tensioning bars (3), one end of which is pressed by a stop (17) or a cam (5) towards the bearing, the other being tensioned by a spring (7) or hydraulic (40–44) arrangement thereagainst. The cam can be released from pressing position upon receiving a "stop print" command. Alternatively, rather than pressing the ends of the pressure bar (3) against fixed portions, for example the side walls (18, 28) of the machine, two adjacent cylinders can be pressed against each other by connecting the respective ends of the pressure bars together, one of the connections preferably including a releasable, for example hydraulic pressure loaded joint (23) and the other having the spring or fluid pressure tensioning force applied thereto.

11 Claims, 5 Drawing Figures

PRINTING CYLINDER ENGAGEMENT PRESSURE REGULATING SYSTEM

Cross reference to related publications: DE-AS No. 26 49 052 DE-OS No. 2 736 175

The present invention relates to a system to generate and control the engagement pressure of mutually engaged cylinders in a rotary printing machine, and more particularly in a rotary offset printing machine.

BACKGROUND AND PRIOR ART

Rotary offset printing machines have three main cylinders: the plate cylinder, the rubber blanket cylinder, and the impression or counter cylinder. The three main cylinders of rotary offset printing machines are subject to oscillations which are derived from non-uniformities of circumference or operating equipment as the cylinders rotate, e.g. various working cycles, such as opening and closing of sheet grippers, run-in and run-out of tensioning grooves, change of flanks of cylinder drive gear wheels, and the like. Bearer rings have been used which are in high engagement pressure with respect to each other. Such bearer rings premit elimination of play upon change of engagement flanks of the gears, and to substantially suppress other cyclically recurring non-uniformities, particularly jolts which occur when the tensioning grooves rotate against a counter cylinder.

Various proposals have been made to improve the smoothness of operation of printing cylinders in rotary offset printing machines. One such proposal—see German Published Patent Application DE-AS No. 26 49 052—has been used to eliminate play in the bearings of printing cylinders. When the tensioning grooves pass another cylinder, substantial jolts and shocks are observed which will be transferred to the printed page as a trailing strip. Additionally, however, the cylinders or, rather, their shafts, are set into oscillations. In order to decrease these shocks and jolts, segmental areas which cover the tensioning grooves have been provided, secured to the cylinder stub shafts, to form bridges spanning the grooves of the respective cylinder. This arrangement reduces relative shift in position of the respective cylinders when in operation. The arrangement uses idler rollers which, in operation, are noisy. The system is still subject to oscillations, however, which occur when the idler rollers engage the circular segmental portions.

A printing system for rotary offset printing machines having rubber cylinders and counter cylinders has been proposed which, instead of bearer rings, utilizes springs inserted between ball bearings in order to stiffen the cylinders and bias them with respect to each other. The cylinders are pressed away from each other by the springs in order to suppress play in the bearings and maintain the cylinders in predetermined position. This system does not, however, permit suppression of oscillations due to shocks and jolts when the grooves of the respective cylinders run against each other. Within the range of the grooves, the engagement pressure is instantaneously reduced so that, by this system, the tendency to oscillation is enhanced. It is not possible to unload the engagement pressure of the printing cylinders with respect to each other when the machine is to be stopped, so that high engagement forces upon stopping of printing will result. Circumferential doubling may occur.

THE INVENTION

It is an object to provide an arrangement and a system in which oscillations which occur particularly upon beginning of printing and end of printing can be effectively suppressed.

Briefly, a bearing, preferably a ball bearing, is positioned on the stub shaft having a stationary outer race. The stationary outer race is engaged, intermediate its length, by an elongated pressure bar. A pressure stop is provided against one end of the pressure bar, the other end of the pressure bar being spring-biassed by an engagement force tending to press the cylinder bearing towards an adjacent cylinder.

The pressure stop can be a cam or a fixed element located on the side wall of the machine, and the tensioning force applied to the other end of the pressure bar can be a spring tension arrangement, preferably adjustable, also secured to the side wall of the machine; in another form, and particularly to engage two rubber blanket cylinders with each other, each one of the rubber blanket cylinders has an elongated pressure bar, and the pressure stops for the pressure bars of the two cylinders are formed by an elongated rod of predetermined or adjustable length with a disconnecting joint therebetween. In one form, the joint may be constructed for engagement upon hydraulic or fluid pressure loading. The other ends of the pressure bars of the two blanket cylinders are connected together by a rod subject to tension spring loading so that, again, the outer races of the bearings are biassed for engagement with the adjacent cylinder.

The system has the advantage that a predetermined compressive force between the parallel engaged cylinders can be obtained. At high speeds, jolts and shocks are damped, particularly upon printing start and printing end, since the pressure bar acts like a cage for the respective cylinder, so that formation of stripes and oscillations which cause damage to bearer rings can be effectively suppressed. The system has the additional advantage that, upon termination of printing, for example upon initiating an instruction command "stop print", a simple connection can be made from the customarily available mechanical stop print shaft to the counter stop, when formed as a cam, so that upon, "stop printing" command, no additional forces need be overcome since the cage is already open during the "stop" command. To start printing, the reverse is commanded, that is, the machine is started with the cylinders out of tight engagement.

Cam stops which permit disengagement of a rubber cylinder with a counter or impression cylinder, or two rubber cylinders against each other, are not necessary with respect to the plate cylinder since usually disconnection of the plate cylinder from the immediately adjacent printing cylinder is not needed. The spring which is used to generate the engagement pressure is preferably adjustably mounted.

The system in which two engaged rubber blanket cylinders, to print on both sides of a web, are formed with a pressure rod also permits control of the respective engagement forces by a compression spring which loads the pressure bars with respect to each other.

DRAWINGS

Figure 1:
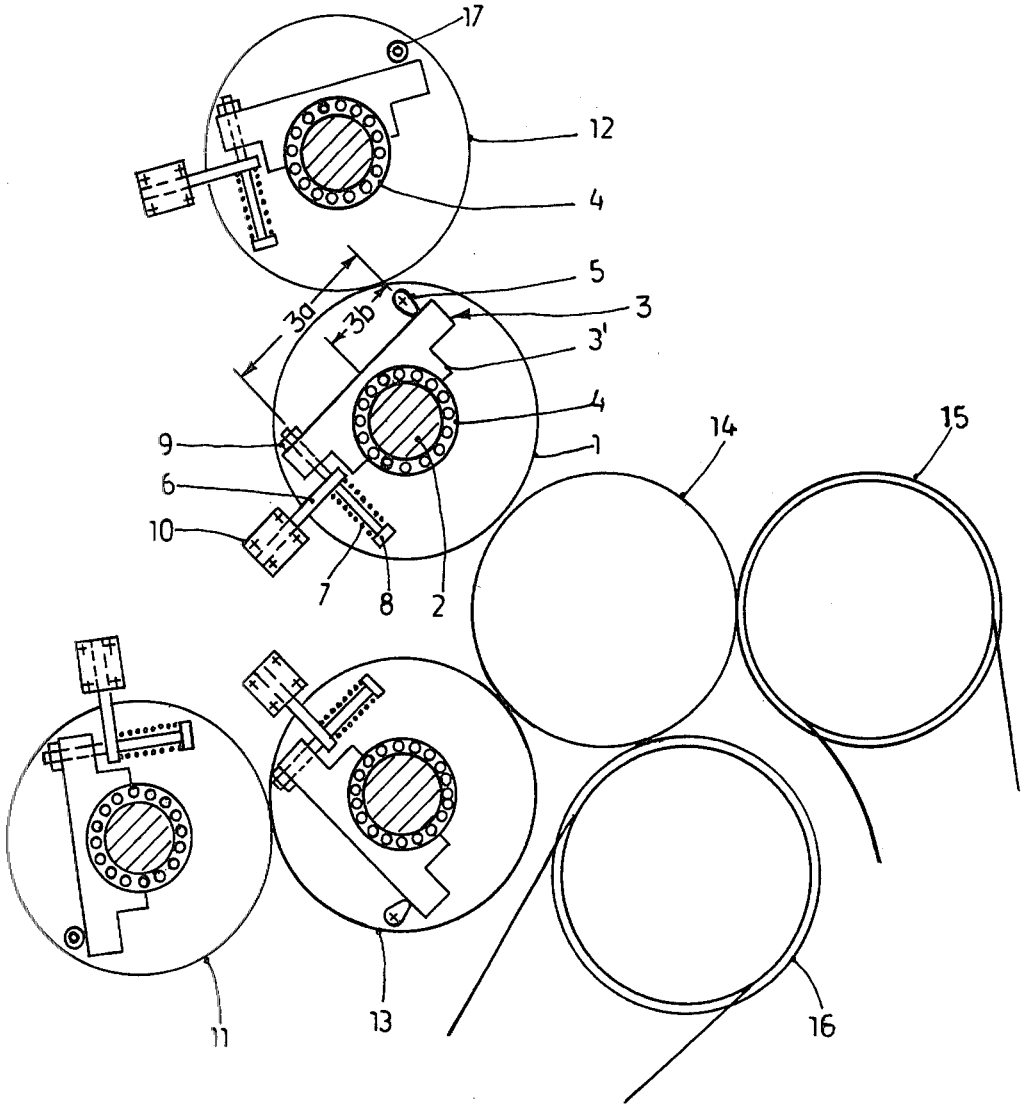
FIG. 1 is a highly schematic side of a printing system of a rotary sheet offset printing machine using the cage construction in accordance with the present invention.

The operating cylinder of rotary sheet offset printing machines—see FIG. 1—preferably do not utilize bearer rings. A sheet on which one side is to be printed, for example in two different colors, is transferred by means of a sheet transfer drum 15 to a counter or impression cylinder 14. The cylinders are not shown in exact engagement for clarity. The impression cylinder 14 carries the sheet past a first rubber blanket cylinder 1, and then past a second rubber blanket cylinder 13. The sheet, then printed for example in two colors, is transferred to a removal drum 16.

Figure 2:
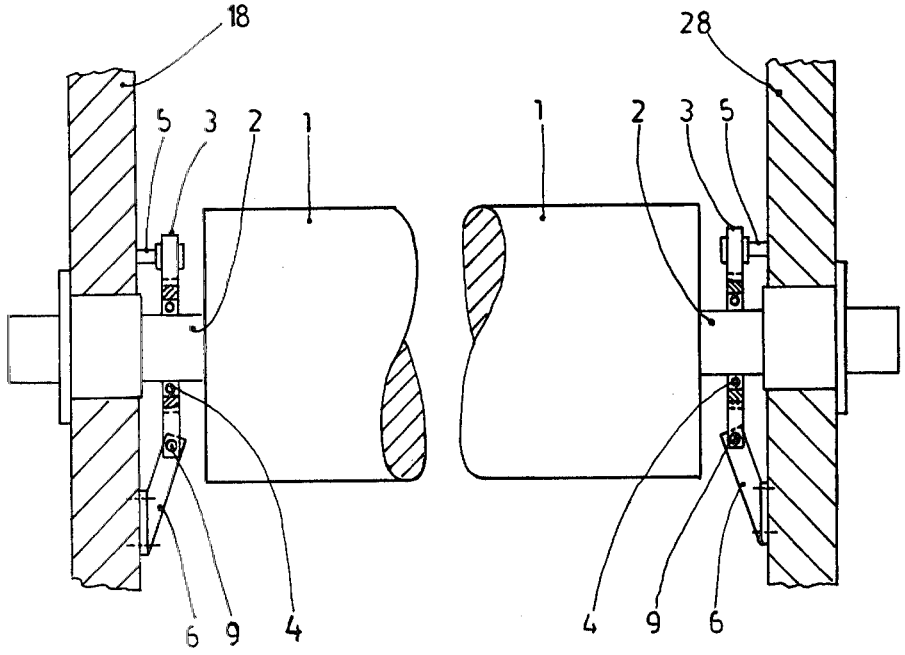
FIG. 2 is a fragmentary schematic front view of a printing cylinder in accordance with FIG. 1.

The rubber blanket cylinder 1 is in engagement with a plate cylinder 12. The second rubber blanket cylinder 13 is in engagement with a plate cylinder 11. Preferably, none of the operating cylinders shown in FIG. 1 has bearer rings. All of the cylinders and drums shown in FIG. 1 are journalled in suitable and customary manner in side walls of the machine. The side walls 18, 28 are schematically shown in FIG. 2; for simplicity, only a single cylinder, the example selected being the first rubber blanket cylinder 1, is shown in FIG. 2. It is understood that the other operating cylinders can have similar bearing pressure arrangements. The cylinder 1 is suitably journalled in the side walls 18, 28 of the machine.

As seen in FIG. 1, the first and second rubber blanket cylinders 1, 13, as well as plate cylinders 11, 12, have a cage construction associated therewith in order to generate a predetermined engagement pressure of mutually parallel operating cylinders. The construction will be described in connection with FIG. 2—i.e. with respect to cylinder 1. The stub shaft 2, suitably journalled in the side wall 18, has a ball bearing 4 placed thereon, positioned between the cylinder 1 and the side wall 18. The inner race of the bearing 4 is secured to the stub shaft 2. The outer race is supported by a pressure bar 3 formed with a cage-like half shell 3' surrounding part of the bearing 4. The elongated pressure bar 3 thus has a shell-like or cage-like portion which extends in part about the outer bearing race of the bearing 4 to support the bearing over an extended portion of its circumference and transfer pressure of the pressure bar on the bearing over an extended area. FIG. 1 shows that the right end of the pressure bar 3—which is elongated—is pressed in a central direction by a cam 5, so that the elongated pressure bar 3 will press with its intermediate portion against the bearing 4. The left end—with respect to cylinder 1 in FIG. 1—is also pressed in a central direction by engagement with a compression spring 7 which surrounds a bolt 8. The bolt 8 is connected by a nut 9 to the left end of the bar 3. A holder 10, secured to the side wall of the machine guides the bolt 8 in locally fixed position and provides a stop for one end of spring 7, the other end of which bears against a bead on the bolt 8 (see FIG. 11).

A similar arrangement, in which similar reference numerals have been used, is applied to the right side of the stub shaft attached to the cylinder 1—see FIG. 2.

Operation: The pressure applied to the bearing 4 is transferred to the stub shaft 2 and hence to the rubber blanket cylinder 1. By turning the bolt 8 in its thread in nut 9, the tension of the spring can be adjusted in a desired value. The pressure bar 3 forms a lever which has a long lever arm **3*a* and a short lever arm 3*b*, thus multiplying the engagement force exerted by spring 7, as compressed by nut 9**, by the lever arm ratio.

The cage construction, surrounding in part the outer race of bearing 4, so presses the blanket cylinder 1 against the impression or counter cylinder 14 that jolts and shocks which occur when the tensioning groove runs against the counter cylinder cannot lead to oscillations. Upon initiation of a command "stop print", in which the rubber blanket cylinder should be cleared from the impression cylinder, for example by means of an eccentric bearing, an additional shaft in connection with the "stop print" shaft (not shown in FIG. 1 and customarily present on printing machine) also controls the cam 5 to swing into a position 90° offset with respect to that shown in FIG. 1 so that no additional forces are applied to the "stop print" mechanism.

As seen in FIG. 1, both blanket cylinders 1, 13 as well as the associated plate cylinders 11, 12, have similar cage or bridge constructions applied thereto. Since the plate cylinders 11, 12 need not be included in the "stop print" command system, it is possible to replace the cam 5 by fixed counter holers 17.

Figure 3:
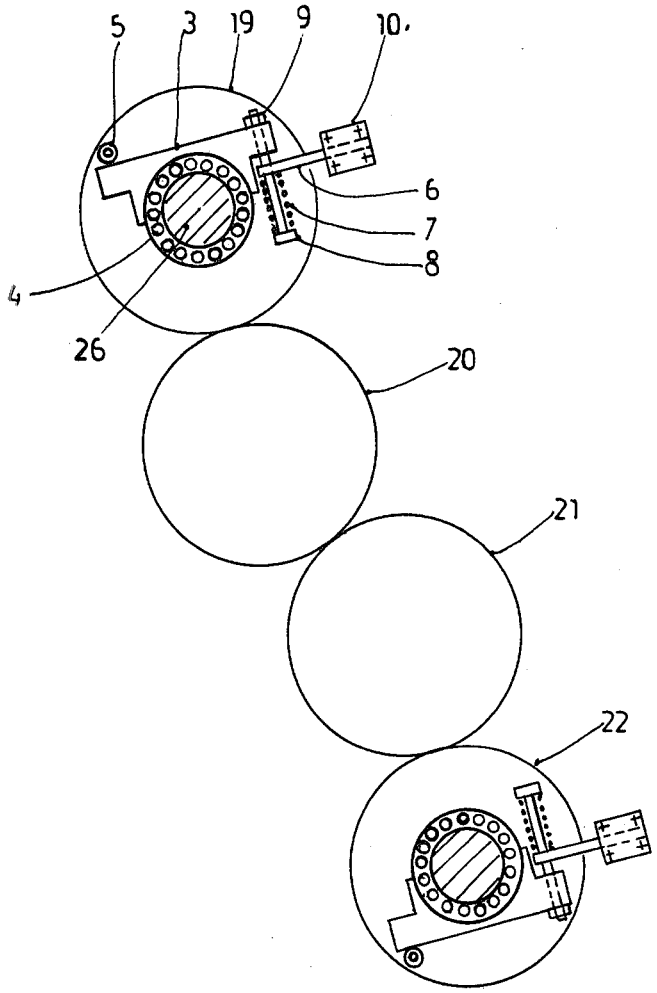
FIG. 3 is a highly schematic side view of a rotary offset printing machine showing printing system cylinders thereof.

Embodiment of FIG. 3: The cage construction is applied to plate cylinders 19 and 22, cooperating with rubber blanket cylinders 20, 21, between which a sheet can be passed for printing on both sides thereof in one operation. The bearings 4 applied to the plate cylinders 19, 22 are so loaded by the bar that the associated rubber blanket cylinder 20, 21, respectively, is subject to substantial torque transfer. Generation of oscillations when two blanket cylinder grooves run against the associated cylinder thus is effectively prevented.

Figure 4:
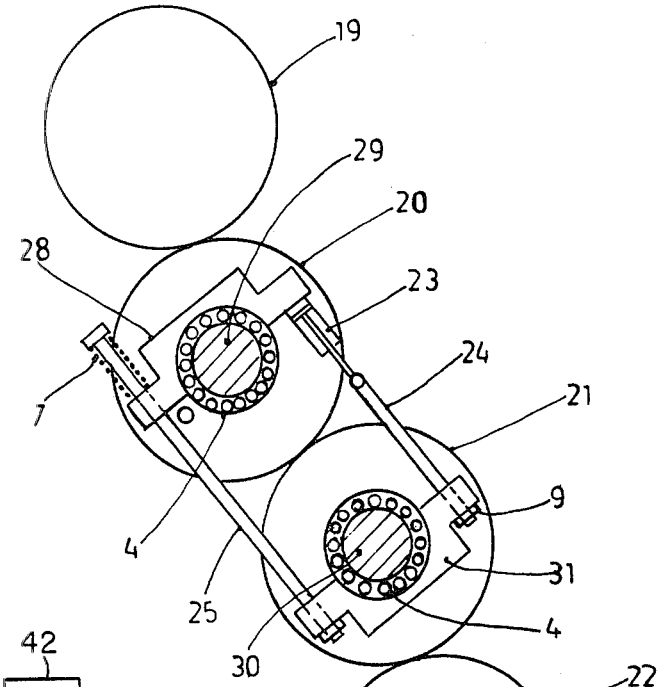
FIG. 4 is another embodiment of a cage construction for a rotary offset printing machine.
Figure 5:
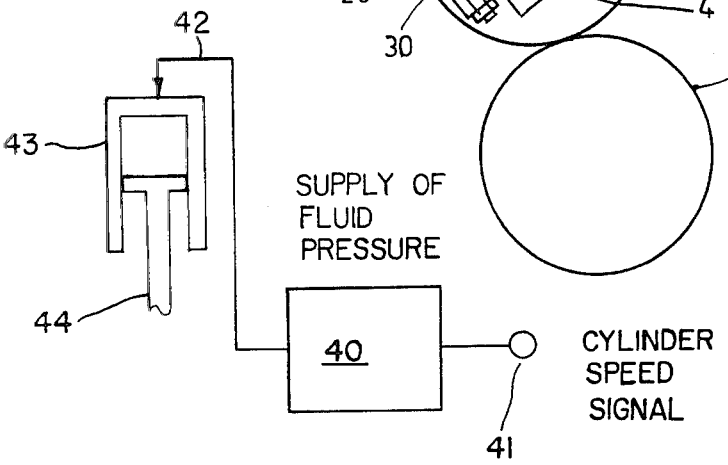
FIG. 5 is a highly schematic diagram showing speed-dependent bearing pressure regulation.

Embodiment of FIG. 4: Rotary offset printing machines for printing on two sides of a sheet between a pair of rubber blanket cylinders can also be constructed by connected the bearings of the associated rubber blanket cylinders together. Plate cylinders 19, 22 are associated with the blanket cylinders 20, 21 which have cages applied to bearings 4 positioned on respective stub shafts 29, 30. One end of the respective bar 28, 31 is connected by a tensioning rod 25 which has the spring 7 applied thereto. The other end of the respective bars 28, 31 is connected by a tensioning rod 24 which is a two-part element joined together at a joint 23, which can be pneumatically or hydraulically opened and closed.

Operation: Spring 7 which, as shown, is a spiral spring surrounding rod 25, can be adjusted in its length by turning rod 25 is a tapped opening in bar 31, or by tightening a nut thereagainst. Adjustment of the desired printing impression force is thus possible. Before separation of the rubber blanket cylinders from each other upon a command "stop print", the joint 23 is opened in order to relieve engagement pressure. Upon starting, that is, upon a command "start print", joint 23 is closed and tensioned. Joint 23, in its simplest form, can be a cylinder-piston arrangement in which the piston, for a "closed" joint travels to the ultimate upper position (with respect to FIG. 4), while it can travel downwardly to open.

The spring 7 can be replaced by a hydraulic or pneumatic force or bias supplying element in order to generate the requisite impression pressure. The impression pressure can be changed in dependence on speed of printing of the operating cylinders. At a high speed, for example 30,000 rpm, the impression pressure can be less than that for a lower speed of, for example, 20,000 rpm.

The arrangement utilizes a cage construction in which the respective operating cylinders of a printing machine are forced towards each other, as in a cage, in which the engagement forces can be controlled, thereby preventing the formation of oscillations within the cylinder system of the printing system.

To control the engagement pressure of the cylinders, a cylinder speed signal is applied to a terminal 41, for example derived from an electrical or mechanical transducer coupled to the printing machine. This speed signal is applied to a source of fluid pressure 40 to provide a pressure fluid, for example hydraulic pressure fluid, through a line 42 to a cylinder-piston arrangement including a cylinder 43 and a piston 44 which may form part of the rod 8 (FIGS. 1, 3) or 25 (FIG. 4) respectively, or be coupled thereto, to supply adjustable fluid pressure in accordance with printing machine speed, thus permitting continuous variation of the engagement pressure between respective cylinders.

Various changes and modifications may be made, and features described in connection with any one of the embodiments may be used with any of the others, within the scope of the inventive concept.

I claim:

1. Printing cylinder engagement pressure generation and control system having at least two parallel printing cylinders which are to be pressed into surface contact engagement, at least one of the cylinders having stub shafts (2) journalled in side walls (18, 28) of the machine, a bearing (4) positioned on the at least one of the stub shafts, having a non-rotatable outer bearing element;

and means (*3a*, *3b*) pressing against the bearing (4) for applying contact pressure on the at least one cylinder towards the other cylinder, comprising an elongated pressure bar (3) forming a lever in engagement with the outer bearing element of the bearing (4) at an intermediate portion of the pressure bar and engaging the bearing at a side of the axis thereof remote from said other cylinder;

a shell-like or cage-like portion on the pressure bar extending at least in part about the outer bearing element of the bearing (4) to support the bearing over an extended portion of its circumference and transfer pressure therefrom over an extended portion of the bearing;

a cam forming a pressure stop (5, 17; 23, 24) engaging the pressure bar laterally of the bearing at one side thereof and fixed to an adjacent side wall (18, 28) of the machine, the cam (5) permitting pressing the pressure bar against the stationary portion of the bearing or relieving pressure therefrom;

and means (6, 7, 8, 9, 10; 25) for forcing the pressure bar against the bearing, said forcing means engaging the pressure bar laterally of the bearing at the other side thereof to force the cylinders toward each other.

2. System according to claim 1, wherein the forcing means comprises a tension force system (7–10) secured to a respective side wall of the machine and applying tension on the pressure bar (3) tending to move the pressure bar into engagement with an adjacent parallel cylinder.

3. System according to claim 1, wherein the forcing means comprises a compression spring (7), and adjustment means coupled to the pressure bar (3) applying the spring force on the pressure bar.

4. System according to claim 1, wherein the respective printing cylinders are a rubber blanket cylinder (1, 13) and an impression or counter cylinder (14) of a rotary offset printing machine.

5. System according to claim 1, wherein the printing cylinders are a plate cylinder (11, 12; 19, 22) and a rubber blanket cylinder (1, 13; 20, 21) of a rotary offset printing machine.

6. System according to claim 1, wherein (FIG. 4) two pressure bars are provided, one each for a bearing associated with a respective cylinder;

the pressure stops for said pressure bars comprise a tensioning rod (23, 24) engaging the pressure bars (3) of parallel cylinders which are to be pressed together;

and the forcing means comprise a connecting tensioning rod (25) connecting said pressure bars and force means tending to press said pressure bars towards each other.

7. System according to claim 6, wherein the force means comprises a spring (7) surrounding one of said tensioning rods;

and wherein one of said tensioning rods includes a releasable tension joint (23).

8. System according to claim 7, wherein the spring (7) surrounds the connecting tensioning rod (25);

and the releasable joint is placed in the other tensioning rod (24).

9. System according to claim 7, wherein the force means comprises fluid force application means.

10. System according to claim 9, further including means providing an output signal representative of operating speed of at least one of the printing cylinders;

and the fluid pressure means apply adjustable fluid pressure at a level depending on the speed of the respective cylinder.

11. System according to claim 1, wherein the printing cylinders are of bearer-ring free construction.

* * * * *